US009583284B2

(12) United States Patent
Kim et al.

(10) Patent No.: US 9,583,284 B2
(45) Date of Patent: Feb. 28, 2017

(54) TAP CHANGER

(71) Applicant: Hyundai Heavy Industries Co., Ltd., Ulsan (KR)

(72) Inventors: Yong Han Kim, Gyeonggi-Do (KR); Yun Bum Park, Gyeonggi-Do (KR); Jae Hi Woo, Ulsan (KR); Bok Yeol Seok, Gyeonggi-Do (KR)

(73) Assignee: Hyundai Heavy Industries Co., Ltd., Ulsan (KR)

( * ) Notice: Subject to any disclaimer, the term of this patent is extended or adjusted under 35 U.S.C. 154(b) by 45 days.

(21) Appl. No.: 14/790,061

(22) Filed: Jul. 2, 2015

(65) Prior Publication Data

US 2016/0012982 A1 Jan. 14, 2016

(30) Foreign Application Priority Data

Jul. 8, 2014 (KR) ..... 10-2014-0085073

(51) Int. Cl.
*H01H 33/666* (2006.01)
*H01H 9/00* (2006.01)
*H01H 19/14* (2006.01)

(52) U.S. Cl.
CPC ..... *H01H 9/0016* (2013.01); *H01H 9/0005* (2013.01); *H01H 2019/146* (2013.01)

(58) Field of Classification Search
CPC ..... H01H 9/0005; H01H 9/0016; H01H 2019/146
See application file for complete search history.

(56) References Cited

U.S. PATENT DOCUMENTS 3,555,403 A * 1/1971 Schweitzer ..... H01H 9/0016 323/343
3,590,175 A 6/1971 Bleibtreu et al.
(Continued)

FOREIGN PATENT DOCUMENTS

CH 493156 A 6/1970
DE 3719680 A1 2/1988
(Continued)

OTHER PUBLICATIONS

European Search Report for European Patent Application No. 15175805, dated Dec. 21, 2015, 4 pages.

*Primary Examiner* — Renee Luebke
*Assistant Examiner* — Ahmed Saeed
(74) *Attorney, Agent, or Firm* — Mintz Levin Cohn Ferris Glovsky and Popeo, P.C.; Peter F. Corless

(57) ABSTRACT

There is provided a tap changer in which movable contacts rotate to be selectively connected to a plurality of taps. The tap changer includes a rotatable upper movable contact; a rotatable lower movable contact electrically connected to the upper movable contact; a driving shaft rotating the upper movable contact and the lower movable contact integrally; a single-type fixed contact including a single terminal connected to any one of a plurality of taps; and a dual-type fixed contact including a first terminal and a second terminal connected together to another of the plurality of taps. Since the upper movable contact and the lower movable contact are integrally rotated through the single driving shaft, the number of components and volume of the device may be reduced and an operation of the device may be facilitated.

7 Claims, 13 Drawing Sheets

(56) References Cited

U.S. PATENT DOCUMENTS

| | | | | |
|---|---|---|---|---|
| 2009/0071806 | A1* | 3/2009 | Xiao | H01H 9/0005 200/11 TC |
| 2010/0038220 | A1 | 2/2010 | Lindsey et al. | |
| 2013/0217110 | A1 | 8/2013 | Ootani et al. | |
| 2014/0159847 | A1* | 6/2014 | Wrede | H02P 13/06 336/150 |

FOREIGN PATENT DOCUMENTS

| | | |
|---|---|---|
| JP | 2012-0696692 | 4/2012 |
| JP | 2013-012507 | 1/2013 |
| JP | 2014-103197 | 6/2014 |
| KR | 10-2014-0060296 | 5/2014 |

* cited by examiner

TAP CHANGER

CROSS-REFERENCE TO RELATED APPLICATION

This application claims the priority and benefit of Korean Patent Application No. 10-2014-0085073 filed on Jul. 8, 2014, with the Korean Intellectual Property Office, the disclosure of which is incorporated herein by reference.

BACKGROUND

The present inventive concept relates to a tap changer and, more particularly, to a tap changer in which movable contacts rotate to be selectively connected to a plurality of taps.

In general, a tap changer is installed in the primary windings of transformers in order to prevent iron cores from being supersaturated when a voltage level of a primary side of the transformer increases to an overvoltage level, equal to or higher than that of a rated voltage.

When a voltage of a secondary side is changed from a rated voltage having a predetermined level due to a change in a voltage level of the primary side, the tap changer serves to adjust the level of the voltage of the secondary side to be equal to that of the rated voltage.

FIGS. 1 through 5 are perspective views and circuit diagrams of a movable contact and a fixed contact illustrating a tap changing operation of a prior art tap changer.

Specifically, FIG. 1 illustrates a case in which tap ⓔ and tap ⓕ are connected, FIG. 2 illustrates a case in which tap ⓓ and tap ⓕ are connected, FIG. 3 illustrates a case in which tap ⓓ and tap ⓖ are connected, FIG. 4 illustrates a case in which tap ⓒ and tap ⓖ are connected, and FIG. 5 illustrates a case in which tap ⓒ and tap ⓗ are connected.

Referring to FIGS. 1 through 5, the prior art tap changer includes an upper movable contact 10 and a lower movable contact 20 coupled to a rotational shaft 40, and a plurality of fixed contacts 30*c* to 30*h* disposed in rotation tracks of the upper movable contact 10 and the lower movable contact 20.

The upper movable contact 10 includes a frame 11 rotatably coupled to the rotational shaft 40 and connection conductors 12 coupled to the frame 11 and selectively connected to the plurality of fixed contacts 30*c* to 30*h* according to rotation of the frame 11.

Like the upper movable contact 10, the lower movable contact 20 includes a frame 21 rotatably coupled to the rotational shaft 40 and connection conductors 22 coupled to the frame 21 and selectively connected to the plurality of fixed contacts 30*c* to 30*h* according to rotation of the frame 21.

Here, the upper movable contact 10 and the lower movable contact 20 are electrically connected to each other.

The frame 11 of the upper movable contact 10 includes a power transmission unit 13 to which an operating unit (not shown) for rotating the upper movable contact 10 is connected. Here, the operating unit pushes the power transmission unit 13 to rotate the upper movable contact 10.

The frame 21 of the lower movable contact 20 includes a power transmission unit 23 to which an operating unit (not shown) for rotating lower movable contact 20 is connected. Here, the operating unit pushes the power transmission unit 23 to rotate the lower movable contact 20.

A first fixed contact 30*c*, a second fixed contact 30*d*, and a third fixed contact 30*e* are disposed in the rotation track of the upper movable contact 10.

A fourth fixed contact 30*f*, a fifth fixed contact 30*g*, and a sixth fixed contact 30*h* are disposed in the rotation track of the lower movable contact 20.

Referring to the circuit diagrams of FIGS. 1 through 5, tap ⓐ corresponds to a minimum number of turns of a coil, and a final number of turns of the coil is determined in tap ⓑ as any one of tap ⓒ, tap ⓓ, and tap ⓔ and any one of tap ⓒ, tap ⓓ, and tap ⓔ are connected by the movable contacts.

Here, tap ⓒ, tap ⓓ, tap ⓔ, tap ⓕ, tap ⓖ, and tap ⓗ may be set to have predetermined differences in number of turns.

For example, in a case in which a minimum number of turns to tap ⓐ is 90 turns, when tap ⓐ and tap ⓑ are directly connected, the number of turns of the coil is 90 turns.

Also, in a case in which a reference number of turns is 10 turns, when tap ⓔ and tap ⓕ are connected, since a difference in the number of turns of tap ⓔ and tap ⓕ is 10 turns, 10 turns are added between tap ⓐ and tap ⓑ, and thus, the final number of turns is 100 turns (90 turns+10 turns).

Also, when tap ⓓ and tap ⓕ are connected, since a difference in number of turns between tap ⓓ and tap ⓕ is 20 turns, 20 turns are added between tap ⓐ and tap ⓑ, and thus, a final number of turns of the coil is 110 turns (90 turns+20 turns).

Under the same principle, when tap ⓒ and tap ⓗ are connected, since a difference in number of turns between tap ⓒ and tap ⓗ is 50 turns, 50 turns are added between tap ⓐ and tap ⓑ, and thus, a final number of turns of the coil is 140 turns (90 turns+50 turns).

Hereinafter, a tap changing operation of the tap changer according to the prior art will be described with reference to FIGS. 1 through 5.

Referring to FIGS. 1 through 5, the first fixed contact 30*c*, the second fixed contact 30*d*, and the third fixed contact 30*e* are disposed in the rotation track of the upper movable contact 10, and the fourth fixed contact 30*f*, the fifth fixed contact 30*g*, and the sixth fixed contact 30*h* are disposed in the rotation track of the lower movable contact 20.

Here, the first fixed contact 30*c* is connected to tap ⓒ, the second fixed contact 30*d* is connected to tap ⓓ, the third fixed contact 30*e* is connected to tap ⓔ, the fourth fixed contact 30*f* is connected to tap ⓕ, the fifth fixed contact 30*g* is connected to tap ⓖ, and the sixth fixed contact 30*h* is connected to tap ⓗ.

First, FIG. 1 illustrates a case in which tap ⓔ and tap ⓕ are connected. The upper movable contact 10 is connected to the third fixed contact 30*e*, and the lower movable contact 20 is connected to the fourth fixed contact 30*f*.

FIG. 2 illustrates a case in which tap ⓓ and tap ⓕ are connected. Here, the upper movable contact 10 rotates in one direction so as to be connected to the second fixed contact 30*d*, and the lower movable contact 20 is connected to the fourth fixed contact 30*f*.

FIG. 3 illustrates a case in which tap ⓓ and tap ⓖ are connected. Here, the upper movable contact 10 is connected to the second fixed contact 30*d* and the lower movable contact 20 rotates in one direction so as to be connected to the fifth fixed contact 30*g*.

FIG. 4 illustrates a case in which tap ⓒ and tap ⓖ are connected. Here, the upper movable contact 10 rotates in one direction so as to be connected to the first fixed contact 30*c* and the lower movable contact 20 is connected to the fifth fixed contact 30*g*.

FIG. 5 illustrates a case in which tap ⓒ and tap ⓗ are connected. Here, the upper movable contact 10 is connected to the first fixed contact 30*c* and the lower movable contact 20 rotates in one direction so as to be connected to the sixth fixed contact 30*h*.

However, in the prior art tap changer, since the upper movable contact 10 and the lower movable contact 20 are independently driven, an operating unit (not shown) for operating the upper movable contact 10 and an operating unit (not shown) for operating the lower movable contact 20 need to be separately provided, resulting in an increase in the number of components of the device, an increase in the volume of the device, and the necessity to control the plurality of operating units.

SUMMARY

An aspect of the present inventive concept may provide a tap changer in which various numbers of turns of a coil may be freely adjusted, while integrally rotating an upper movable contact and a lower movable contact.

According to an aspect of the present inventive concept, a tap changer may include: a rotatable upper movable contact; a rotatable lower movable contact electrically connected to the upper movable contact; a driving shaft rotating the upper movable contact and the lower movable contact integrally; a single-type fixed contact including a single terminal connected to any one of a plurality of taps; and a dual-type fixed contact including a first terminal and a second terminal connected together to another of the plurality of taps, wherein one single-type fixed contact and at least one dual-type fixed contact are disposed in a rotation track of the upper movable contact, and at least one dual-type fixed contact and one single-type fixed contact are disposed in a rotation track of the lower movable contact.

When the upper movable contact is connected to the single-type fixed contact disposed in the rotation track thereof, the lower movable contact is connected to a first terminal of the dual-type fixed contact disposed in the rotation track thereof, when the upper movable contact is connected to a first terminal of the dual-type fixed contact disposed in the rotation track thereof, the lower movable contact is connected to a second terminal of the dual-type fixed contact disposed in the rotation track thereof, and when the upper movable contact is connected to a second terminal of the dual-type fixed contact disposed in the rotation track thereof, the lower movable contact is connected to a first terminal of the dual-type fixed contact or the single-type fixed contact disposed in the rotation track thereof.

The tap changer may further include a rotary frame including the upper movable contact provided in an upper portion thereof and the lower movable contact provided in a lower portion thereof, and coupled to the driving shaft.

The dual-type fixed contact may include a dual-type body portion coming into contact with the upper movable contact and the lower movable contact, and the dual-type body portion may have a bar shape extending along the rotation tracks of the upper movable contact and the lower movable contact.

The single terminal, the first terminal, and the second terminal are disposed at equal intervals along the rotation tracks of the upper movable contact and the lower movable contact.

A plurality of dual-type fixed contacts may be disposed in the rotation track of the upper movable contact, a plurality of dual-type fixed contacts may be disposed in the rotation track of the lower movable contact, the upper movable contact may be rotated according to rotation of the driving shaft so as to be selectively connected to any one of the single-type fixed contact and the plurality of dual-type fixed contacts disposed in the rotation track thereof, and the lower movable contact may be rotated according to rotation of the driving shaft so as to be selectively connected to any one of the plurality of dual-type fixed contacts and the single-type fixed contact disposed in the rotation track of the lower movable contact.

The single-type fixed contact and the plurality of dual-type fixed contacts may be disposed in this order in the rotation track of the upper movable contact, and the plurality of dual-type fixed contacts and the single-type fixed contact may be disposed in this order in the rotation track of the lower movable contact.

BRIEF DESCRIPTION OF DRAWINGS

The above and other aspects, features and advantages of the present inventive concept will be more clearly understood from the following detailed description taken in conjunction with the accompanying drawings, in which.

DETAILED DESCRIPTION

Figure 1:
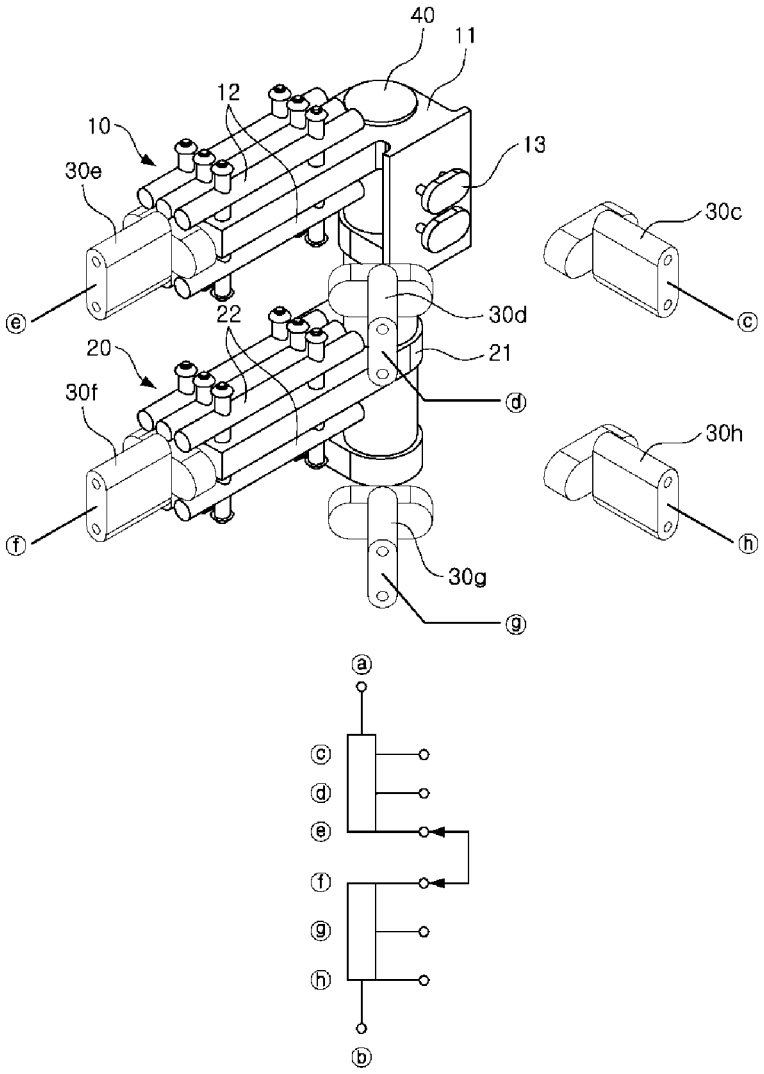
PRIOR ART FIG. 1
FIG. 1 includes a perspective view and a circuit diagram of a movable contact and a fixed contact in a state in which tap ⓔ and tap ⓕ of a tap changer according to the prior art.
Figure 2:
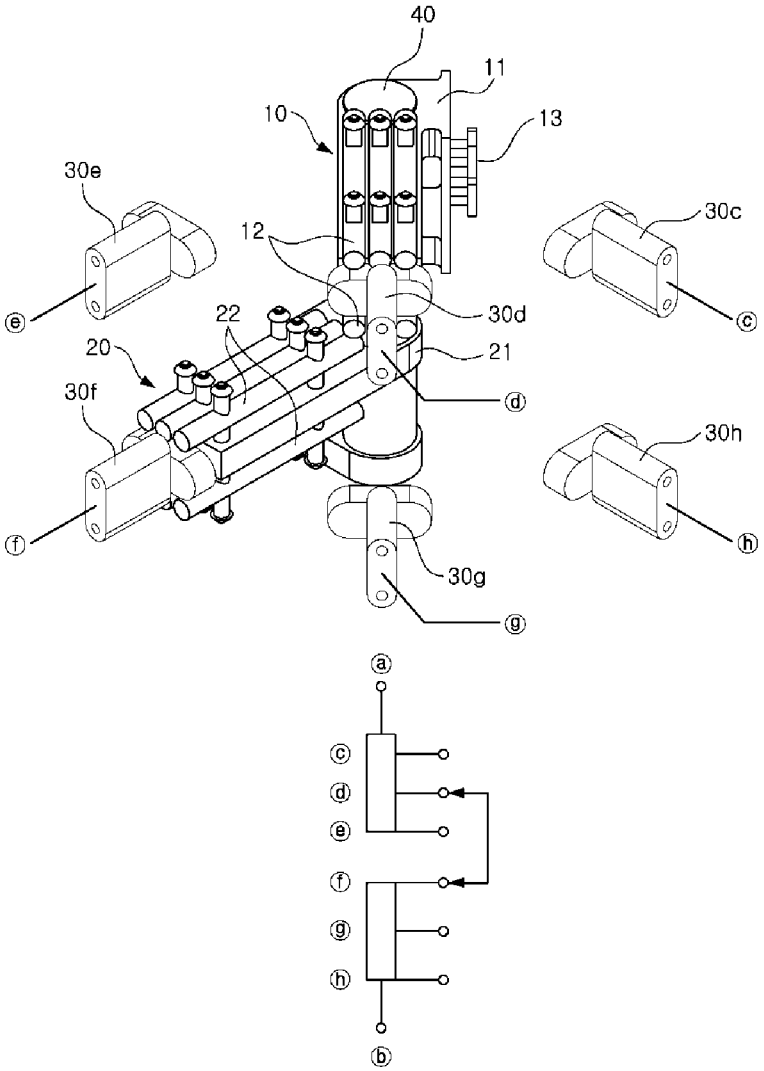
PRIOR ART FIG. 2
FIG. 2 includes a perspective view and a circuit diagram of the movable contact and the fixed contact in a state in which tap ⓓ and tap ⓕ of the tap changer illustrated in FIG. 1.
Figure 3:
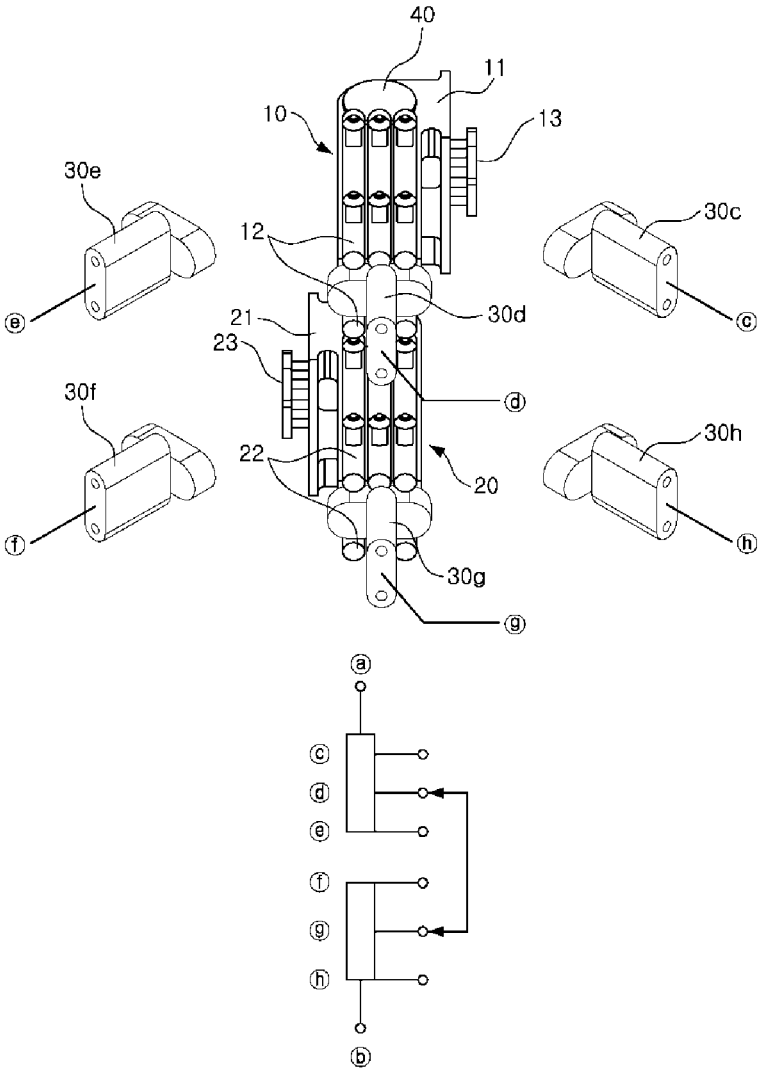
PRIOR ART FIG. 3
FIG. 3 includes a perspective view and a circuit diagram of the movable contact and the fixed contact in a state in which tap ⓓ and tap ⓖ of the tap changer illustrated in FIG. 1.
Figure 4:
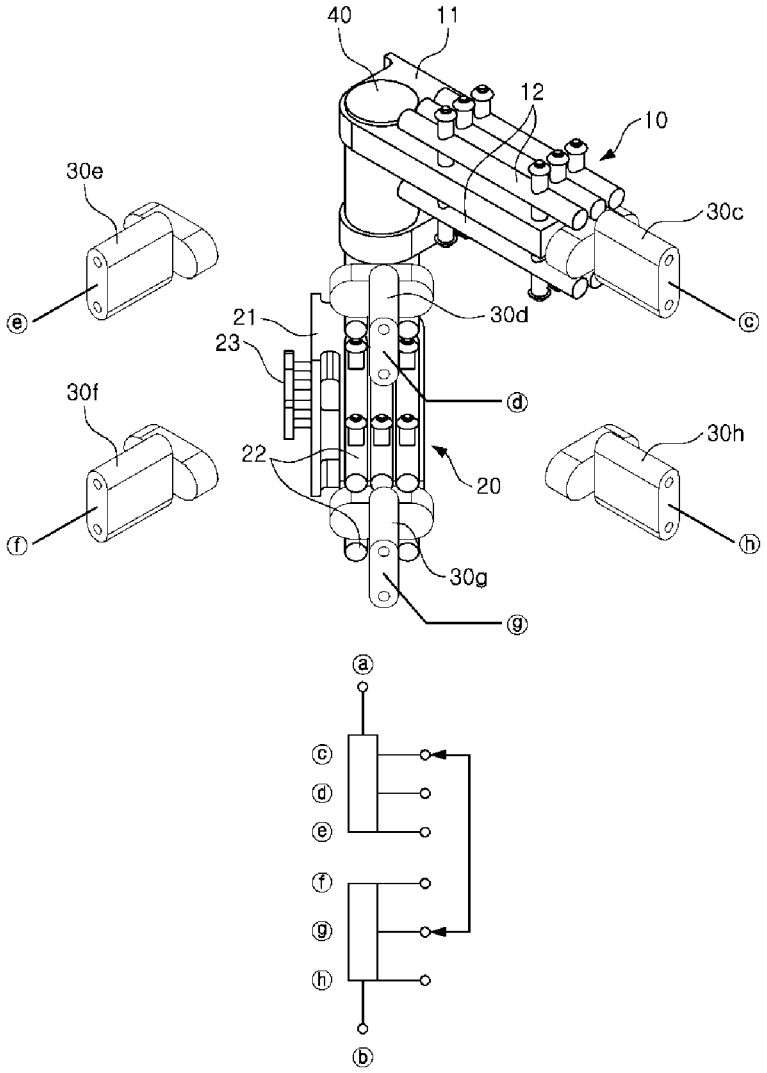
PRIOR ART FIG. 4
FIG. 4 includes a perspective view and a circuit diagram of the movable contact and the fixed contact in a state in which tap ⓒ and tap ⓖ of the tap changer illustrated in FIG. 1.
Figure 5:
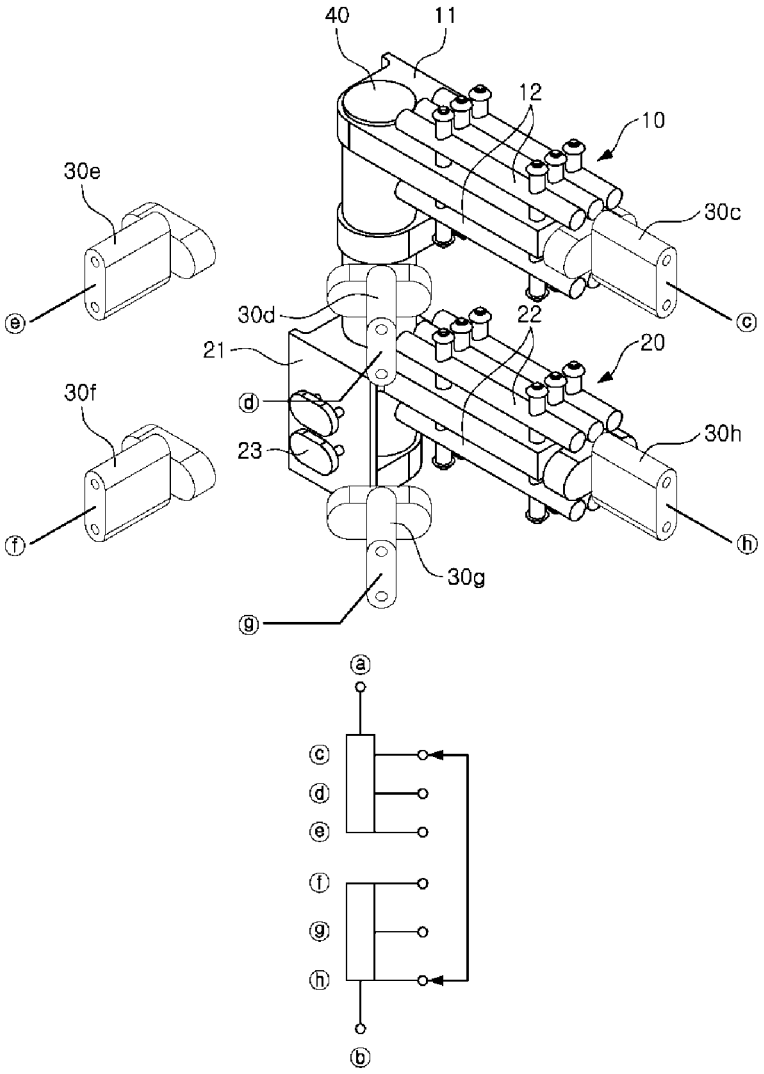
PRIOR ART FIG. 5
FIG. 5 includes a perspective view and a circuit diagram of the movable contact and the fixed contact in a state in which tap ⓒ and tap ⓗ of the tap changer illustrated in FIG. 1.

Hereinafter, exemplary embodiments of the present inventive concept will be described in detail with reference to the accompanying drawings.

The inventive concept may, however, be exemplified in many different forms and should not be construed as being limited to the specific embodiments set forth herein. Rather, these embodiments are provided so that this disclosure will be thorough and complete, and will fully convey the scope of the inventive concept to those skilled in the art.

In the drawings, the shapes and dimensions of elements may be exaggerated for clarity, and the same reference numerals will be used throughout to designate the same or like elements.

First, a configuration of a tap changer according to an exemplary embodiment of the present inventive concept will be described with reference to FIGS. 6 through 8.

Figure 6:
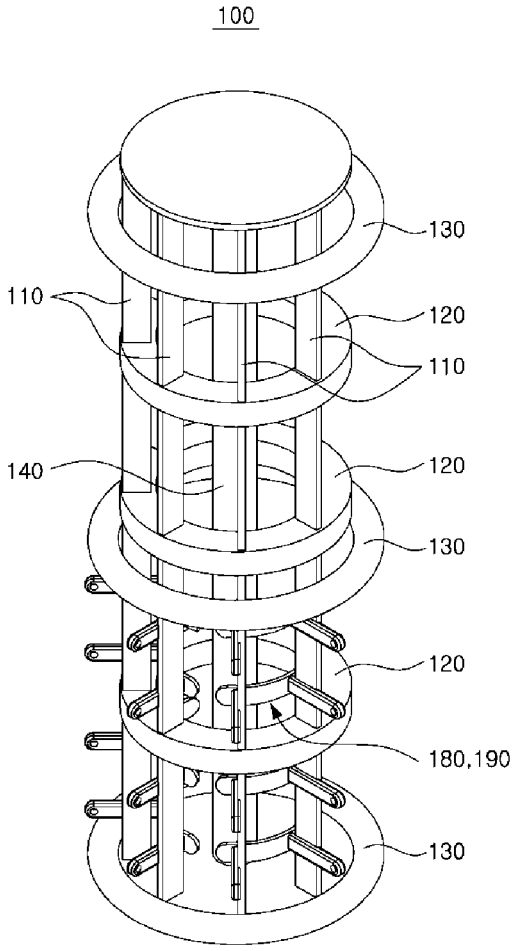
FIG. 6 is a perspective view of a tap changer according to an exemplary embodiment of the present inventive concept.
Figure 7A:
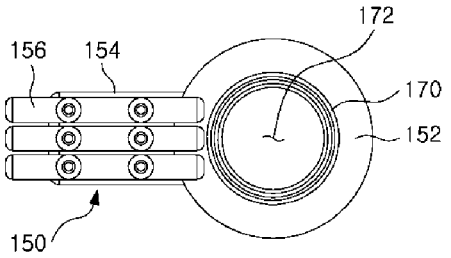
FIGS. 7A and 7B are a plan view and a side view of an upper movable contact, a lower movable contact, and a rotary frame included in the tap changer illustrated in FIG. 6.
Figure 7B:
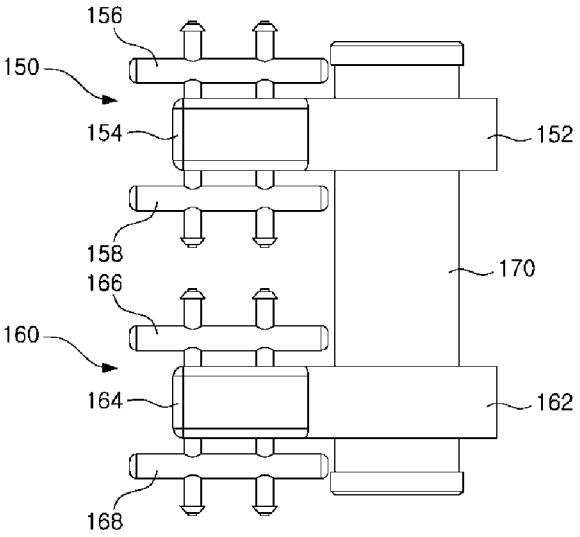
Figure 8:
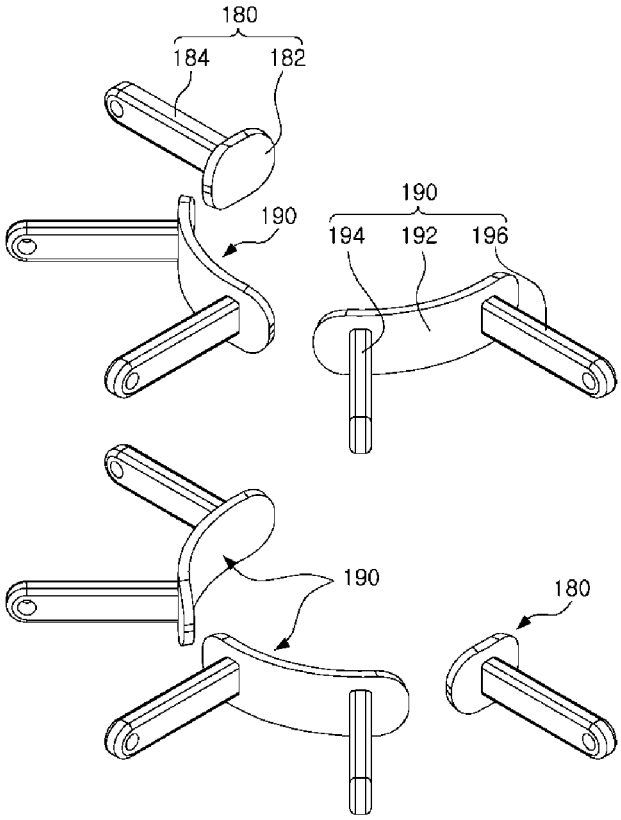
FIG. 8 is a perspective view illustrating fixed contacts included in the tap changer illustrated in FIG. 6.

As illustrated in FIGS. 6 through 8, the tap changer 100 according to an exemplary embodiment of the present inventive concept may include a support frame 110, a fixing frame 120, an annular member 130, a driving shaft 140, an upper movable contact 150, a lower movable contact 160, a single-type fixed contact 180, and a dual-type fixed contact 190.

As illustrated in FIG. 6, the support frame 110 may include a plurality of bars disposed in a circle, like pillars set up on the edges of a cylindrical structure overall.

The support frame 110 may support a single-type fixed contact 180 and a dual-type fixed contact 190.

The fixing frame 120, a structure fixing positions of a plurality of support frames 110, may be configured as an annular member.

The annular member 130, surrounding the outer side of the support frames 110, may serve to maintain spaces between an enclosure (not shown) of the tap changer 100 according to an exemplary embodiment of the present inventive concept and the fixed contacts 180 and 180.

The driving shaft 140 may be connected to the upper movable contact 150 and the lower movable contact 160 (to be described hereinafter) and integrally rotate the upper movable contact 150 and the lower movable contact 160 through rotation.

The tap changer 100 according to an exemplary embodiment of the present inventive concept may operate the upper movable contact 150 and the lower movable contact 160 through the single driving shaft 140 such that behaviors thereof are identical.

The upper movable contact 150 may be rotatably coupled to the driving shaft 140 and selectively connected to any one of the single-type fixed contact 180 and a plurality of dual-type fixed contacts 190 (to be described hereinafter), while in rotation.

The upper movable contact 150, together with the lower movable contact 160 (to be described hereinafter), serves as a medium electrically connecting the fixed contacts 180 and 190.

In an exemplary embodiment, the upper movable contact 150 may include a coupling unit 152, an extending unit 154, and connection units 156 and 158.

Here, the coupling unit 152 may be connected to a rotary frame 170 (to be described hereinafter) and transmit rotational force of the rotary frame 170 to the connection units 156 and 158.

The extending unit 154, extending to one side from the coupling unit 152, may form a structure allowing the connection units 156 and 158 to be provided therein.

The connection units 156 and 158 may be provided in the extending unit 154 and may come into direct contact with the single-type fixed contact 180 and the dual-type fixed contact 190 (to be described hereinafter) to electrically connect the single-type fixed contact 180 and the dual-type fixed contact 190 to the upper movable contact 150.

In an exemplary embodiment, the connection units 156 and 158 may include an upper connection unit 156 disposed above the extending unit 154 and a lower connection unit 158 disposed below the extending unit 154.

In this configuration, the upper connection unit 156 and the lower connection unit 158 may be brought into contact with upper and lower ends of a single-type body portion 182 of the single-type fixed contact 180 and a dual-type body portion 192 of the dual-type fixed contact 190.

Like the upper movable contact 150, the lower movable contact 160 may be rotatably coupled to the driving shaft 140 and may be selectively connected to any one of the single-type fixed contact 180 and the plurality of dual-type dual-type fixed contacts 190 (to be described hereinafter), while in rotation.

The lower movable contact 160 may be disposed below the upper movable contact 150.

In an exemplary embodiment, as illustrated in FIG. 7, the lower movable contact 160 may include a coupling unit 162, an extending unit 164, and connection units 166 and 168.

Here, the coupling unit 162 may be coupled to the rotary frame 170 (to be described hereinafter and transmit rotational force of the rotary frame 170 to the connection units 166 and 168.

The extending unit 164, extending to one side from the coupling unit 162, may form a structure allowing the connection units 166 and 168 to be provided therein.

The connection units 166 and 168 may be provided in the extending unit 164 and may come into direct contact with the single-type fixed contact 180 and the dual-type fixed contact 190 (to be described hereinafter) to electrically connect the single-type fixed contact 180 and the dual-type fixed contact 190 to the upper movable contact 150.

In an exemplary embodiment, the connection units 166 and 168 may include an upper connection unit 166 disposed above the extending unit 164 and a lower connection unit 168 disposed below the extending unit 164.

In this configuration, the upper connection unit 166 and the lower connection unit 168 may be brought into contact with upper and lower ends of the single-type body portion 182 of the single-type fixed contact 180 and the dual-type body portion 192 of the dual-type fixed contact 190.

The upper movable contact 150 and the lower movable contact 160 may be provided in the rotary frame 170.

The rotary frame 170 is a cylindrical member with a hollow portion 172 to which the driving shaft 140 is coupled. The coupling unit 152 of the upper movable contact 150 may be coupled to an upper end of the rotary frame 170 and the coupling unit 162 of the lower movable contact 160 may be coupled to a lower end of the rotary frame 170.

The rotary frame 170 may rotate according to rotation of the driving shaft 140 and transmit rotational force of the driving shaft 140 to the upper movable contact 150 and the lower movable contact 160.

The rotary frame 170 may be formed of a conductor and electrically connect the upper movable contact 150 and the lower movable contact 160.

As illustrated in FIG. 8, the fixed contact 180 may include the single-type body portion 182 and a single terminal 184.

The single-type body portion 182 may be configured to be inserted into spaces between the upper connection units 156 and 166 and the lower connection units 158 and 168 of the upper movable contact 150 and the lower movable contact 160, and electrically connect the single terminal 184 and the upper movable contact 150.

The single terminal 184 may have a bar shape outwardly protruding from the single-type body portion 182, and may be connected to any one of a plurality of taps provided in a transformer coil.

As illustrated in FIG. 8, the dual-type fixed contact 190 may include the dual-type body portion 182, a first terminal 184, and a second terminal 196.

The dual-type body portion 182 is a conductor configured to be inserted into spaces between the upper connection units 156 and 166 and the lower connection units 158 and 168 of the upper movable contact 150 and the lower movable contact 160 to electrically connect the single terminal 184 and the upper movable contact.

Unlike the single-type body portion 182, the dual-type body portion 192 may be configured as a bar-type conductor extending in an arc shape along a rotation track of the upper movable contact 150 and the lower movable contact 160.

Accordingly, when the upper movable contact 150 and the lower movable contact 160 rotate, the upper connection units 156 and 166 and the lower connection units 158 and 168 of the upper movable contact 150 and the lower movable contact 160 may slide in a state of being connected to the dual-type body portion 192.

Also, the first terminal 194 may be configured to have a bar shape protruding outwardly from one side of the dual-type body portion 192, and may be connected to another tap among the plurality of gaps provided in the transformer coil.

The second terminal 196 may be configured to have a bar shape protruding outwardly from one side of the dual-type body portion 192 and may be connected together to the tap to which the first terminal 194 is connected.

In an exemplary embodiment, as illustrated in FIG. 8, the dual-type fixed contact 190 may be configured by integrating two single-type fixed contacts 180.

Meanwhile, in an exemplary embodiment, one single-type fixed contact and a plurality of dual-type fixed contacts 190 are disposed in a rotation track of the upper movable contact 150, and a plurality of dual-type fixed contacts 190 and one single-type fixed contact 180 may be disposed in a rotation track of the lower movable contact 160.

For example, in the rotation track of the upper movable contact 150, the fixed contacts may be disposed in order of the single-type fixed contact 180 and the plurality of dual-type fixed contacts 190 with reference to a counterclockwise direction of FIG. 8.

In the rotation track of the lower movable contact 160, the fixed contacts may be disposed in order of the plurality of dual-type fixed contacts 190 and the single-type fixed contact 180.

Here, the single-type fixed contact 180 and the dual-type fixed contacts 190 may be configured such that the single terminal 184, the first terminal 194, and the second terminal 196 are disposed at equal intervals along the rotation tracks of the upper movable contact 150 and the lower movable contact 160, but the disposition of the single terminal 184, the first terminal 194, and the second terminal 196 is not limited thereto.

Through the disposition structure of the fixed contacts, the disposition structure of the fixed contacts 180 and 190 disposed in the rotation track of the upper movable contact 150 may be bilaterally symmetrical to the disposition structure of the fixed contacts 180 and 190 disposed in the rotation track of the lower movable contact 160.

Connections between the movable contacts and the fixed contacts of the tap changer 100 according to an exemplary embodiment of the present inventive concept having the foregoing configuration will be described.

First, when the upper movable contact 150 is connected to the single-type fixed contact 180 disposed in the rotation track of the upper movable contact 150, the lower movable contact 160 may be connected to the first terminal 194 of the dual-type fixed contact 190 disposed in the rotation track of the lower movable contact 160.

When the upper movable contact 150 is connected to the first terminal 194 of the dual-type fixed contact 190 disposed in the rotation track of the upper movable contact 150, the lower movable contact 160 may be connected to the second terminal 196 of the dual-type fixed contact 190 disposed in the rotation track of the lower movable contact 160.

When the upper movable contact 150 is connected to the second terminal 196 of the dual-type fixed contact 190 disposed in the rotation track of the upper movable contact 150, the lower movable contact 160 may be connected to the first terminal 194 of the dual-type fixed contact 190 disposed in the rotation track of the lower movable contact 160 or connected to the single-type fixed contact 180 disposed in the rotation track of the lower movable contact 160.

Hereinafter, a specific tap changing operation of the tap changer 100 according to an exemplary embodiment of the present inventive concept will be described with reference to FIGS. 9 through 13.

First, as illustrated in FIGS. 9 through 13, a first single-type fixed contact 180*e*, a first dual-type fixed contact 190*d*, and a second dual-type fixed contact 190*c* may be disposed in the rotation track of the upper movable contact 150.

A third dual-type fixed contact 190*f*, a fourth dual-type fixed contact 190*g*, and a second single-type fixed contact 180*h* may be disposed in the rotation track of the lower movable contact 160.

Here, tap ⓒ of the transformer coil may be connected to a first terminal 194*c* and a second terminal 196*c* of the second dual-type fixed contact 190*c*, tap ⓓ may be connected to a first terminal 194*d* and a second terminal 196*d* of the first dual-type fixed contact 190*d*, tap ⓔ may be connected to a single terminal 184*e* of the first single-type fixed contact 180*e*, tap ⓕ may be connected to a first terminal 194*f* and a second terminal 196*f* of the third dual-type fixed contact 190*f*, tap ⓖ may be connected to a first terminal 194*g* and a second terminal 196*g* of the fourth dual-type fixed contact 190*g*, and tap ⓗ may be connected to a single terminal 184*h* of the second single-type fixed contact 180*h*.

Figure 9:
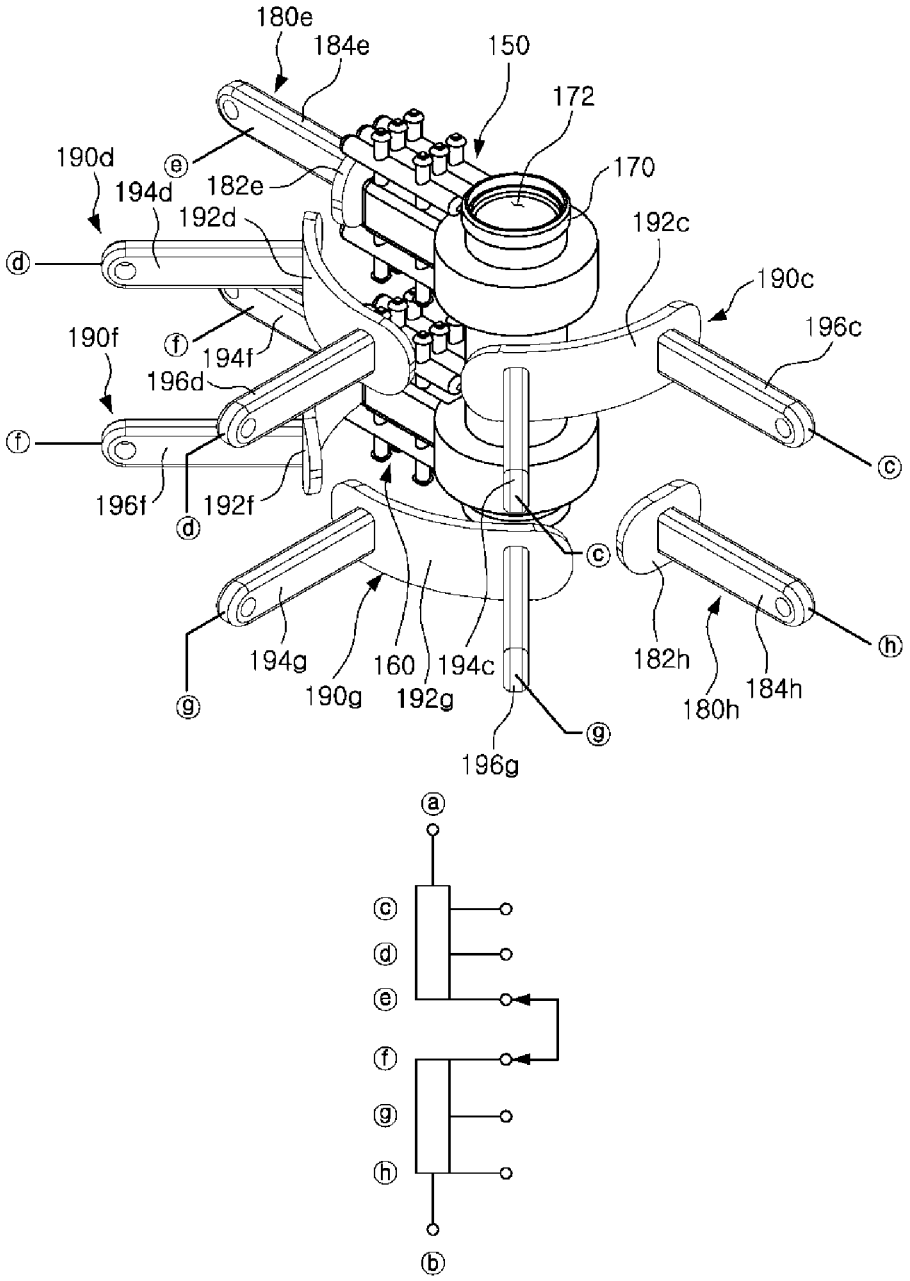
FIG. 9 includes a perspective view and a circuit diagram of a movable contact and a fixed contact in a state in which tap ⓓ and tap ⓕ of the tap changer illustrated in FIG. 6 are connected.

FIG. 9 illustrates a state in which tap ⓔ and tap ⓕ are connected.

Referring to FIG. 9, when the upper movable contact 150 is connected to the single-type body portion 182 of the first single-type fixed contact 180*e*, the lower movable contact 160 is connected to the dual-type body portion 192 of the third dual-type fixed contact 190*f*. Here, the lower movable contact 160 is disposed to be adjacent to the first terminal 194*f* of the third dual-type fixed contact 190*f*.

Figure 10:
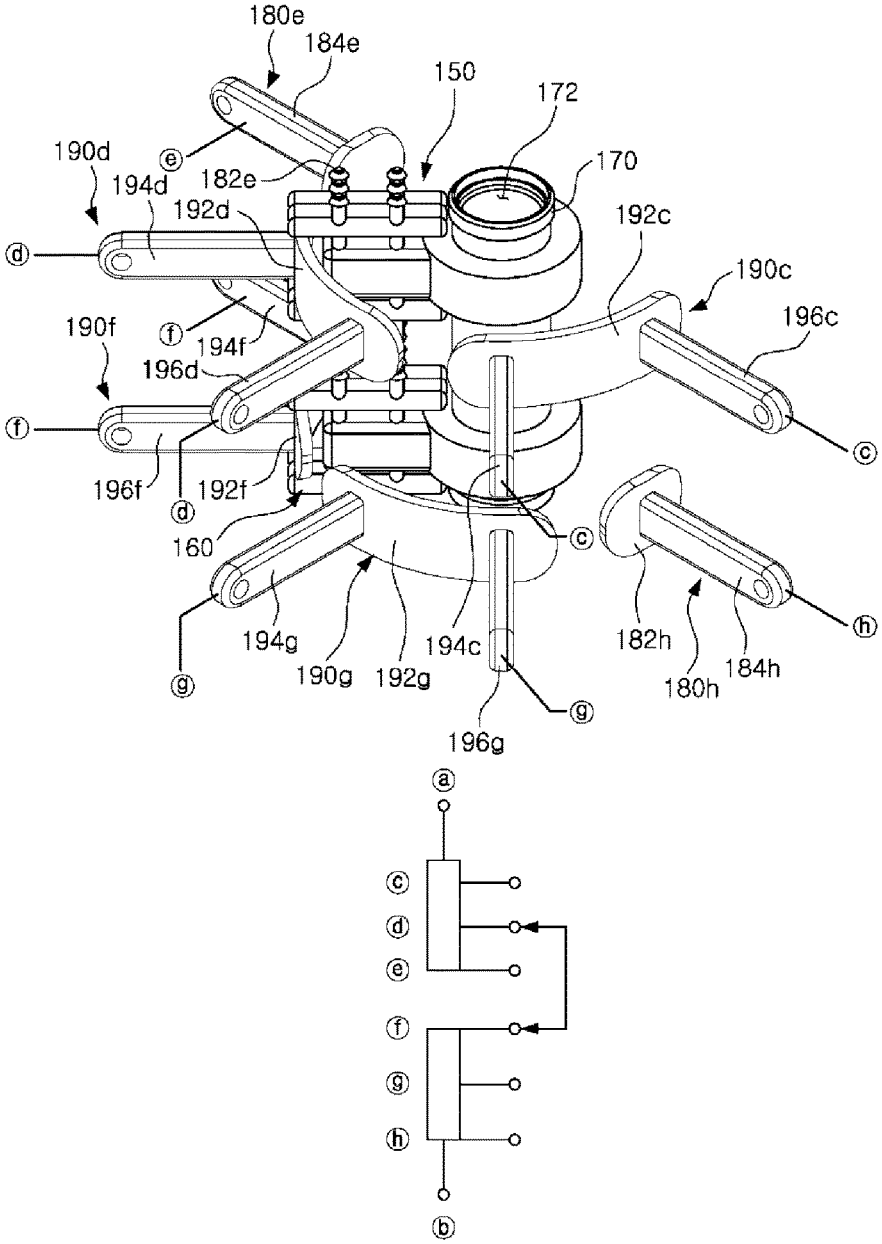
FIG. 10 includes a perspective view and a circuit diagram of a movable contact and a fixed contact in a state in which tap ⓓ and tap ⓕ of the tap changer illustrated in FIG. 6 are connected.

FIG. 10 is a view illustrating a state in which tap ⓓ and tap ⓕ are connected.

Referring to FIG. 10, when the upper movable contact 150 rotates in a direction so as to be connected to a dual-type body portion 192*d* of the first dual-type fixed contact 190*d*, the lower movable contact 160 rotates in the same direction as that of the upper movable contact 150 so as to be connected to a dual-type body portion 192*f* of the third dual-type fixed contact 190*f*. Here, the upper movable contact 150 is disposed to be adjacent to he first terminal 194*d* of the first dual-type fixed contact 190*d*, and the lower movable contact 160 is disposed to be adjacent to the second terminal 196*f* of the third dual-type fixed contact 190*f*.

In other words, even when the driving shaft 140 rotates and the upper movable contact 150 is connected to the first dual-type fixed contact 190*d*, changing from the first single-type fixed contact 180*e*, so as to be connected to tap ⓓ, the lower movable contact 160 may be maintained in a state of being connected to the third dual-type fixed contact 190*f* connected to tap ⓕ.

This contact connection structure may be realized through a configuration in which the third dual-type fixed contact 190*f* extends along the rotation track of the lower movable contact 160 by a length corresponding to a distance from the first single-type fixed contact 180*e* to the first terminal 194*d* of the first dual-type fixed contact 190*d*.

Figure 11:
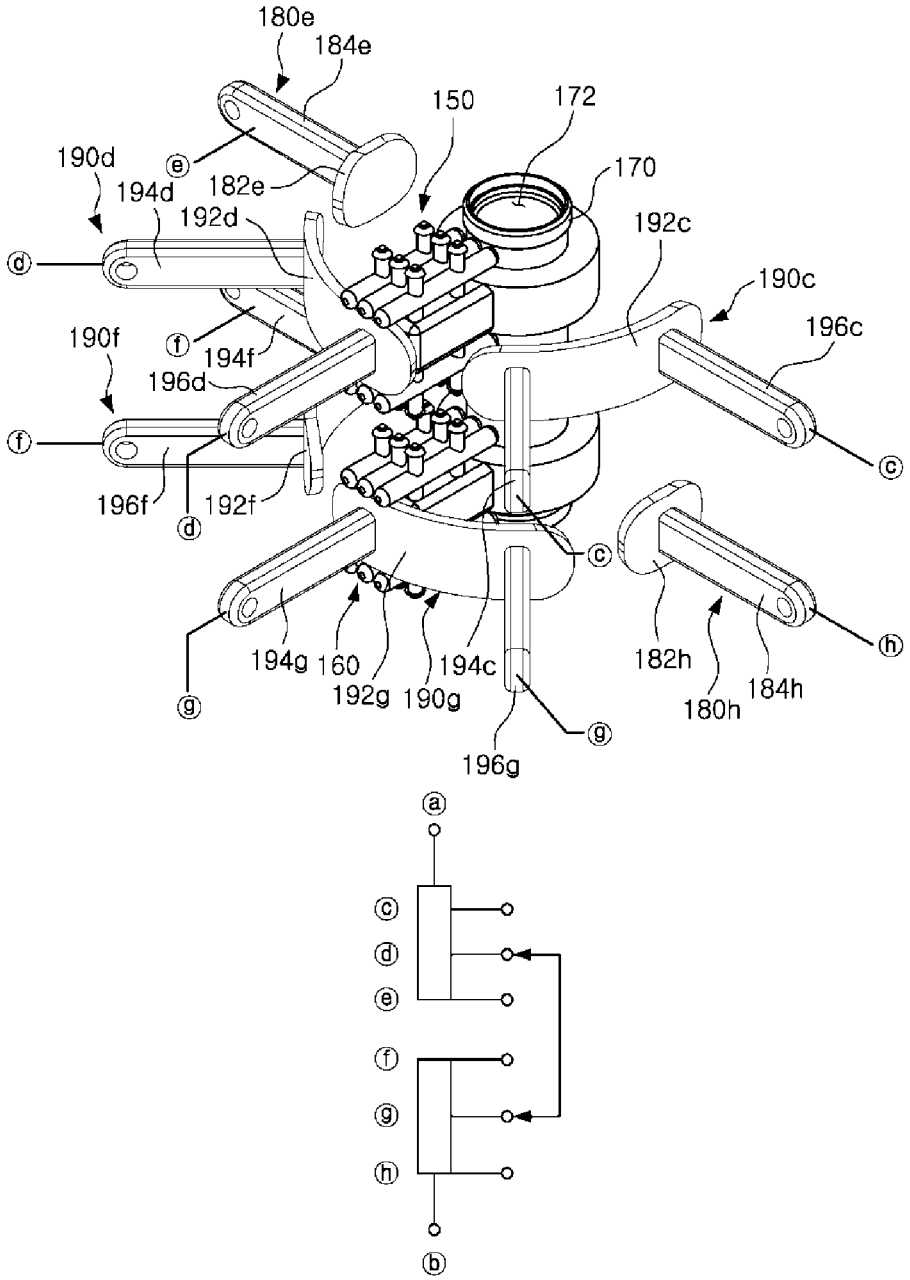
FIG. 11 includes a perspective view and a circuit diagram of a movable contact and a fixed contact in a state in which tap ⓓ and tap ⓖ of the tap changer illustrated in FIG. 6 are connected.

FIG. 11 illustrates a state in which tap ⓓ and tap ⓖ are connected.

Referring to FIG. 11, when the upper movable contact 150 rotates in a direction and slides along the dual-type body portion 192*d* of the first dual-type fixed contact 190*d* so as to be disposed to be adjacent to the second terminal 196*d* of the first dual-type fixed contact 190*d*, the lower movable contact 160 rotates in the same direction as that of the upper movable contact 150 so as to be connected to a dual-type body portion 192*g* of the fourth dual-type fixed contact 190*g*. Here, the lower movable contact 160 is disposed to be adjacent to the first terminal 194*g* of the fourth dual-type fixed contact 190*g*.

This contact connection structure may be realized through a configuration in which the second terminal 196*f* of the third dual-type fixed contact 190*f* is disposed below the first terminal 194*d* of the first dual-type fixed contact 190*d* and the first terminal 194*g* of the fourth dual-type fixed contact 190*g* is disposed below the second terminal 196*d* of the first dual-type fixed contact 190*d*.

That is, in an exemplary embodiment, when the lower movable contact 160 is disposed directly below the upper movable contact 150, the plurality of dual-type fixed contacts 190 disposed in the rotation track of the upper movable contact 150 and the plurality of dual-type fixed contacts 190 disposed in the rotation track of the lower movable contact 160 stagger in a zigzag manner.

Figure 12:
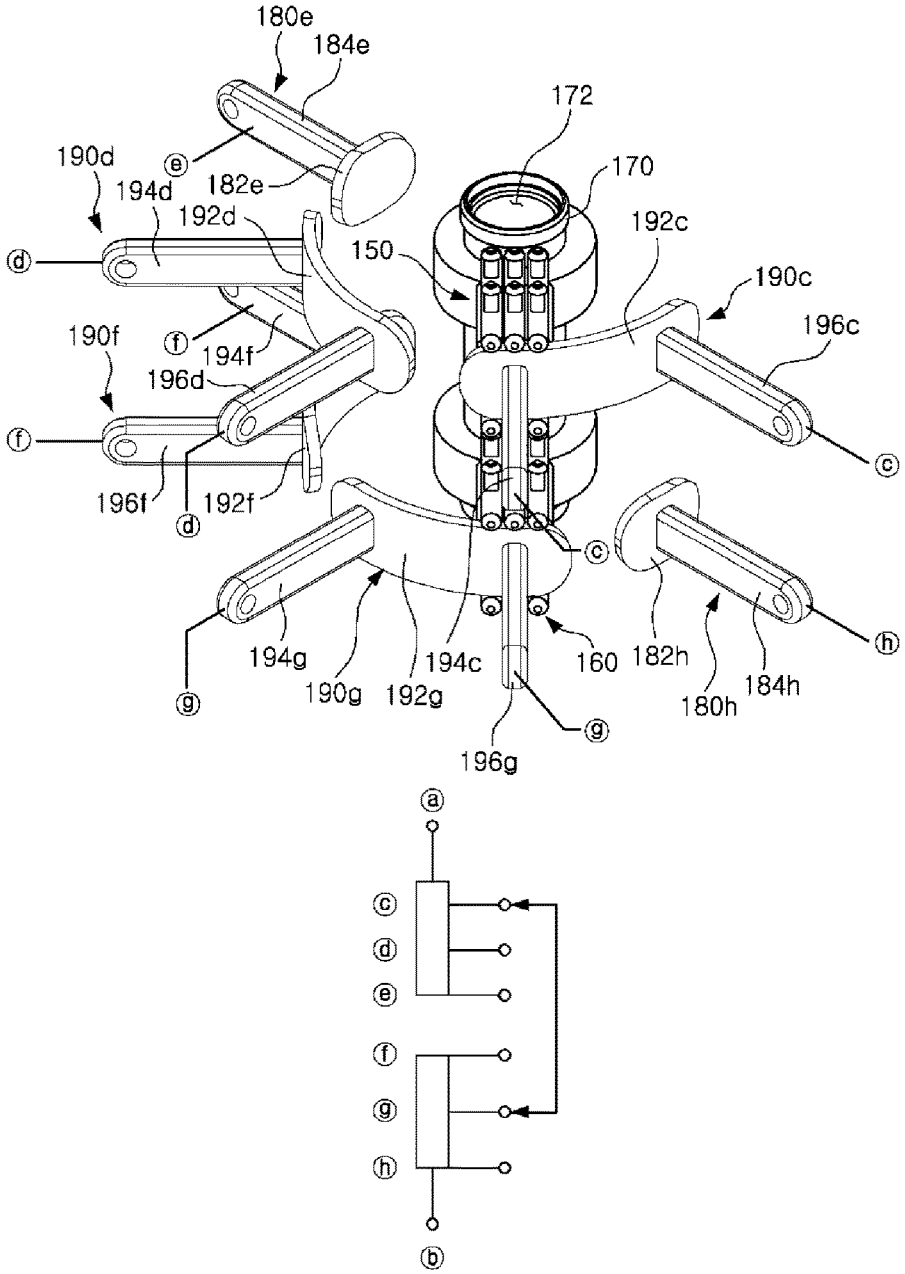
FIG. 12 includes a perspective view and a circuit diagram of a movable contact and a fixed contact in a state in which tap ⓒ and tap ⓖ of the tap changer illustrated in FIG. 6 are connected.

FIG. 12 illustrates a structure in which tap ⓒ and tap ⓖ are connected.

Referring to FIG. 12, when the upper movable contact 150 rotates in one direction so as to be connected to a dual-type body portion 192*c* of the second dual-type fixed contact 190*c*, the lower movable contact 160 rotates in the same direction so as to be connected to the fourth dual-type fixed contact 190*g*. Here, the upper movable contact 150 is disposed to be adjacent to the first terminal 194*c* of the second dual-type fixed contact 190*c*, and the lower movable contact 160 is disposed to be adjacent to the second terminal 196*g* of the fourth dual-type fixed contact 190*g*.

Figure 13:
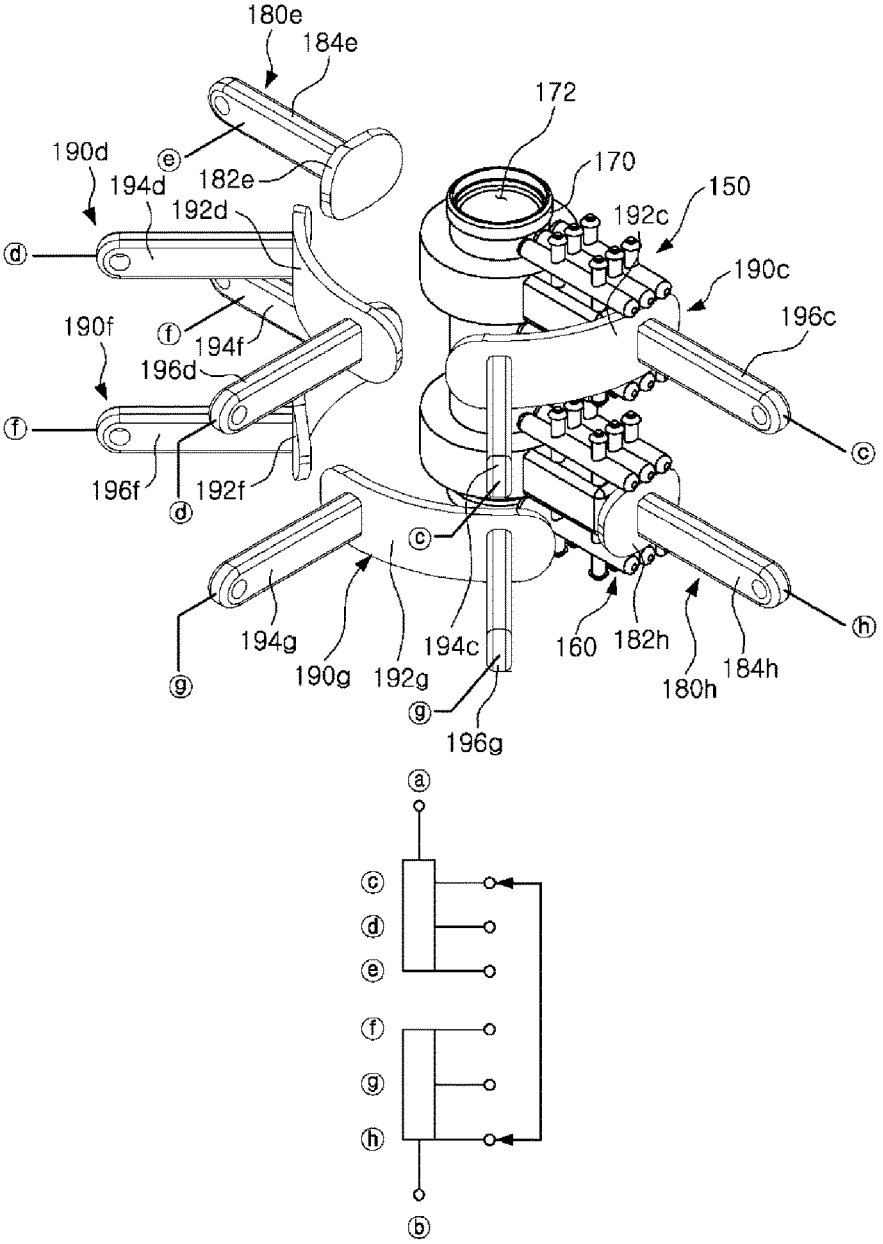
FIG. 13 includes a perspective view and a circuit diagram of a movable contact and a fixed contact in a state in which tap ⓒ and tap ⓗ of the tap changer illustrated in FIG. 6 are connected.

FIG. 13 illustrates a structure in which tap ⓒ and tap ⓗ are connected.

Referring to FIG. 13, when the upper movable contact 150 rotates in one direction so as to be disposed to be adjacent to the second terminal 196*c* of the second dual-type fixed contact 190*c*, the lower movable contact 160 rotates in the same direction as that of the upper movable contact 150 so as to be connected to the second single-type fixed contact 180*h*.

Thus, in the tap changer 100 according to an exemplary embodiment of the present inventive concept, the number of turns of the coil may be adjusted, while rotating the upper movable contact 150 and the lower movable contact 160 integrally through the single driving shaft 140, by using the dual-type fixed contact 190.

As set forth above, according to exemplary embodiments of the present inventive concept, since the upper movable contact and the lower movable contact are rotated integrally through the single driving shaft, the number of components and volume of the device may be reduced and operation of the device may be facilitated.

While exemplary embodiments have been shown and described above, it will be apparent to those skilled in the art that modifications and variations could be made without departing from the scope of the invention as defined by the appended claims.

What is claimed is:

1. A tap changer comprising:

a rotatable upper movable contact;

a rotatable lower movable contact electrically connected to the upper movable contact;

a driving shaft rotating the upper movable contact and the lower movable contact integrally;

a single-type fixed contact including a single terminal connected to any one of a plurality of taps; and a dual-type fixed contact including a first terminal and a second terminal connected together to another of the plurality of taps, wherein one single-type fixed contact and at least one dual-type fixed contact are disposed in a rotation track of the upper movable contact, and at least one dual-type fixed contact and one single-type fixed contact are disposed in a rotation track of the lower movable contact.

2. The tap changer of claim 1, wherein when the upper movable contact is connected to the single-type fixed contact disposed in the rotation track thereof, the lower movable contact is connected to a first terminal of the dual-type fixed contact disposed in the rotation track thereof, when the upper movable contact is connected to a first terminal of the dual-type fixed contact disposed in the rotation track thereof, the lower movable contact is connected to a second terminal of the dual-type fixed contact disposed in the rotation track thereof, and when the upper movable contact is connected to a second terminal of the dual-type fixed contact disposed in the rotation track thereof, the lower movable contact is connected to a first terminal of the dual-type fixed contact or the single-type fixed contact disposed in the rotation track thereof.

3. The tap changer of claim 1, further comprising a rotary frame including the upper movable contact provided in an upper portion thereof and the lower movable contact provided in a lower portion thereof, and coupled to the driving shaft.

4. The tap changer of claim 1, wherein the dual-type fixed contact includes a dual-type body portion coming into contact with the upper movable contact and the lower movable contact, and the dual-type body portion has a bar shape extending along the rotation tracks of the upper movable contact and the lower movable contact.

5. The tap changer of claim 1, wherein the single terminal, the first terminal, and the second terminal are disposed at equal intervals along the rotation tracks of the upper movable contact and the lower movable contact.

6. The tap changer of claim 1, wherein a plurality of dual-type fixed contacts are disposed in the rotation track of the upper movable contact, a plurality of dual-type fixed contacts are disposed in the rotation track of the lower movable contact, the upper movable contact is rotated according to rotation of the driving shaft so as to be selectively connected to any one of the single-type fixed contact and the plurality of dual-type fixed contacts disposed in the rotation track thereof, and the lower movable contact is rotated according to rotation of the driving shaft so as to be selectively connected to any one of the plurality of dual-type fixed contacts and the single-type fixed contact disposed in the rotation track of the lower movable contact.

7. The tap changer of claim 6, wherein the single-type fixed contact and the plurality of dual-type fixed contacts are disposed in this order in the rotation track of the upper movable contact, and the plurality of dual-type fixed contacts and the single-type fixed contact are disposed in this order in the rotation track of the lower movable contact.

* * * * *